US007625026B2

(12) United States Patent
Lau

(10) Patent No.: US 7,625,026 B2
(45) Date of Patent: Dec. 1, 2009

(54) ANIMAL LITTER COLLECTOR

(75) Inventor: Tung Yan Lau, N.T. (HK)

(73) Assignee: Design Manufacture Limited, N.T. (HK)

( * ) Notice: Subject to any disclaimer, the term of this patent is extended or adjusted under 35 U.S.C. 154(b) by 0 days.

(21) Appl. No.: 11/938,312

(22) Filed: Nov. 12, 2007

(65) Prior Publication Data

US 2009/0121502 A1 May 14, 2009

(51) Int. Cl.
*A01K 29/00* (2006.01)
*E01H 1/12* (2006.01)

(52) U.S. Cl. ..... 294/1.3; 294/55; 15/257.1

(58) Field of Classification Search ..... 294/1.3, 294/1.4, 1.5, 55; 383/4, 78, 79, 81, 92; 15/257.1; 119/161

See application file for complete search history.

(56) References Cited

U.S. PATENT DOCUMENTS 4,252,356 A * 2/1981 Tokuzumi ..... 294/1.3
4,272,116 A * 6/1981 Tufte, Jr. ..... 294/1.3
4,458,932 A * 7/1984 Resch ..... 294/1.3
4,483,560 A * 11/1984 Lordi ..... 294/1.3
4,741,565 A * 5/1988 Bagg ..... 294/1.3
4,909,553 A * 3/1990 Hantover ..... 294/1.3
5,564,762 A * 10/1996 Ring ..... 294/1.3
5,584,519 A * 12/1996 Myles et al. ..... 294/1.3
5,865,486 A * 2/1999 Bussani ..... 294/1.3

FOREIGN PATENT DOCUMENTS

CH 665861 * 6/1988

* cited by examiner

*Primary Examiner*—Dean J Kramer

(57) ABSTRACT

An animal litter collector, comprising a foldable board and a foldable bag having an opening, wherein the foldable board is thin, flat and elongated having a receptacle portion at one end for receiving animal litter, a handle portion in the middle for holding with the human hand and a fastening portion at the other end with a fastener for closing the opening of the foldable bag by fixing it in place; one side of the opening of the foldable bag is fixed onto the fastening portion of the board, and the fastener of the fastening portion is in shape and position that can engage with the other side of the opening to fix it in place and keep the opening closed after animal litter is disposed inside the foldable bag. The present invention is to provide an animal litter collector which is portable, simple and easy to use, and is susceptible of a low cost of manufacture and an affordable price of sale, and can effectively pick up and hold the litter for disposal.

19 Claims, 8 Drawing Sheets

ANIMAL LITTER COLLECTOR

BACKGROUND OF THE INVENTION

The present invention relates to an animal litter collector and more particularly pertains to a disposable animal litter collector for picking up and holding the litter for disposal after use.

In many jurisdictions, pet owners are statutorily required to collect litter of their pets as soon as pet litter is deposited on streets in city areas. To avoid penalty of fines, pet owners are generally willing to collect and dispose litter left by their pets in public areas. For sanitary purposes and aesthetic considerations, pet owners also need to clean up litter in their own private areas. These needs are particularly notorious for dog owners living in the cities as it is common for them to take their dogs out for a walk everyday in public areas such as sidewalks, parks or even beaches. The most basic tool that a dog owner has to bring along is waste newspaper or a used bag which the dog owner can use to pick up the dog's litter. Though the dog owner's hands may not touch the litter directly, most dog owners find the act disgusting. Some dog owners use small implements such as small shovels, but unless these implements are disposable, subsequent cleaning up of the implements remains to be distasteful.

There are a number of disposable means to assist dog owners to clean up after their dogs. Most of them require complicated assembly or folding before use. Therefore, one may see a dog owner who has to hurriedly attach a handle to a base to form a shovel in order to clean up the litter before his dog runs away. One may also see a dog owner who spends time to fold a cardboard paper into its predetermined shape such as a box or a prism as if he is doing a handicraft in order to clean up the litter for disposal. There are some other disposable means in the marketplace which are simple in construction and convenient to carry. They are usually made of cardboard paper with pressed lines so that they can be easily folded into a shovel. A dog owner can use the shovel to clean up the litter and put the whole thing into a bag for disposal. It is simple and easy.

However, this kind of disposable means also has defects. A dog owner has to remember to bring a disposal bag with him in order to complete the disposal process. If the dog owner forgets to bring a bag or does not have one, he will have to carry the litter with the disposal shovel for a while before it can be disposed into a rubbish bin. Further, it is not hygienic to simply dispose the litter into a rubbish bin without putting it into a bag first. Moreover, the dog owner also has to choose a suitable bag carefully. If the bag is too small, it cannot hold the shovel with the litter all together. If the bag is too large, it will not be compact in size and it may take time to fold and unfold the bag. Furthermore, the most commonly available bags are probably plastic bags from supermarkets or convenience stores. These bags are usually light in color and transparent to some degree. Therefore, it remains to be disgusting to carry the litter around with such a see-through plastic bag.

BRIEF SUMMARY OF THE INVENTION

In view of the aforesaid disadvantages now present in the prior art, the object of the present invention is to provide an animal litter collector which is portable, simple and easy to use, and is susceptible of a low cost of manufacture and an affordable price of sale, and can effectively pick up and hold the litter for disposal.

To attain this, the present invention generally comprises a foldable board and a foldable bag having an opening, wherein the foldable board is thin, flat and elongated having a receptacle portion at one end for receiving animal litter, a handle portion in the middle for holding with the human hand and a fastening portion at the other end with a fastener for closing the opening of the foldable bag by fixing it in place; or alternatively, the handle portion at one end and the receptacle portion in the middle; and the handle portion together with the receptacle portion can be separated from the fastening portion; one side of the opening of the foldable bag is fixed onto the fastening portion of the board, and the fastener of the fastening portion is in shape and position that can engage with the other side of the opening to fix it in place and keep the opening closed after animal litter is disposed inside the foldable bag.

When the receptacle portion is at one end of the foldable board, the handle portion is in the middle and the fastening portion is at the other end, the three portions can be folded in a way that the receptacle portion or the fastening portion lies in between the other two portions; or alternatively, when the handle portion is at one end of the foldable board, the receptacle portion is in the middle and the fastening portion is at the other end, the three portions can be folded in a way that the handle portion or the fastening portion lies in between the other two portions; or alternatively, the receptacle portion together with the handle portion can be folded onto the fastening portion and the foldable bag so that the animal litter collector is folded into half or approximately half of its size.

The receptacle portion and the handle portion may have at least one pressed line or perforated line in between enabling that one portion to be easily folded onto the other portion.

The receptacle portion and the handle portion may have two curved or inclined pressed lines or perforated lines which run from the two corners or areas near the two corners of one side of the receptacle portion through the opposite side of the receptacle portion that connects to one side of the handle portion and up to the opposite side of the handle portion enabling that the handle portion and the receptacle portion can be folded into a shovel-like implement for taking up animal litter.

The two curved or inclined pressed lines or perforated lines can be symmetrical in shape and position.

The two end points of the two curved or inclined pressed lines or perforated lines on the handle portion are in positions which separate the edge of the side of the handle portion into three sections of approximately equal length enabling that the handle portion can be folded into a handle for ease of holding with the human hand.

The handle portion and the fastening portion may have a tear-off line in between which enables the handle portion together with the receptacle portion to be easily separated from the fastening portion. Alternatively, the receptacle portion and the fastening portion may have a tear-off line in between which enables the receptacle portion together with the handle portion to be easily separated from the fastening portion.

The fastener on the fastening portion may be in the form of a hanger which is opened on the fastening portion with the bottom side attached to the fastening portion, and the foldable bag has a hole or a cut line on the other side of the opening which side is not fixed onto the fastening portion, and the hole or the cut line is in size and position corresponding to the size and position of the hanger enabling that when the litter is disposed into the foldable bag, the other side of the opening is pulled down due to the weight inside and the hanger engages with the hole or the cut line, thereby fixing the other side of the opening in place and keeping the opening of the foldable bag closed.

The fastener on the fastening portion may be in the form of a flap which is opened on the fastening portion with one side attached to the fastening portion, and the foldable bag has a cut line or a hole on the other side of the opening which side is not fixed onto the fastening portion and the cut line or the hole is in size and position corresponding to the size and position of the flap enabling that the flap can engage with the cut line or the hole to fix the other side of the opening in place and to keep the opening of the foldable bag closed.

The receptacle portion, the handle portion and the fastening portion are preferably of the same size or substantially the same size.

The receptacle portion, the handle portion and the fastening portion can be folded into one-third or substantially one-third.

The receptacle portion and the handle portion are preferably of the same size or substantially the same size, and the fastening portion is of the same width as that of the receptacle portion or the handle portion and its length is relatively shorter than that of the receptacle portion or the handle portion facilitating ease of folding and providing room for storing the foldable bag which is fixed onto the fastening portion.

The width of the opening of the foldable bag is preferably greater than that of the receptacle portion and that of the handle portion.

The length of the foldable bag is preferably greater than the total length of the receptacle portion plus the handle portion.

The board can be made of paper, cardboard, plastic or wood.

The foldable bag can be made of paper or plastic.

The foldable bag is preferably dark in color for making animal litter inside invisible from outside.

The edge of the side of the receptacle portion that is used to pick up animal litter may be slanted or toothed for facilitating ease of taking up.

The receptacle portion may have a plurality of perforations for filtering out excess grass, sand or stones when taking up animal litter.

To use the present invention, the user can first unfold the receptacle portion, the handle portion, the fastening portion and the foldable bag if they are folded into a compact size, and then tear off the handle portion and the receptacle portion from the fastening portion along the tear-off line. The user may then fold the receptacle portion and the handle portion along the two curved or inclined pressed lines, thereby making it into the shape of a shovel for picking up animal litter. The user then holds the handle portion with one hand and uses the receptacle portion to pick up the litter.

After taking up the litter, the user can put the handle portion and the receptacle portion with the litter hereon into the foldable bag. The user then uses the fastener which is in the form of a hanger or a flap on the fastening portion to fix the other side of the opening in place and to keep the opening of the foldable bag closed. As the foldable bag has a hole or cut line in size and position corresponding to the size and position of the hanger or the flap, the user can engage the hanger or the flap with the hole or the cut line. The user may further fold the hanger or the flap upward and use it as a hook to keep the opening of the foldable bag closed.

In comparison with the prior art, the present invention has the following advantages and effects:

First, since the animal litter collector of the present invention is of simple construction with a thin, flat and elongated board and a foldable bag, it is portable and light in weight and can be folded into a compact size for ease of carrying. It is therefore more susceptible of a low cost of manufacture and an affordable price of sale.

Secondly, the user is only required to tear off the handle portion and the receptacle portion from the fastening portion or vice versa and then fold the handle portion and the receptacle portion into a shovel for picking up animal litter. The user can then simply put the whole thing into the foldable bag and use the fastener of the fastening portion to close the opening of the folding bag. It is simple and easy to use.

Thirdly, the foldable bag is part of the invention and this construction saves the trouble of the pet owner to find a suitable bag and also solves the problem of the pet owner of forgetting to bring a bag with him.

Finally, the present invention can be made from recyclable and biodegradable material such as paper, cardboard or wood. It is environmentally friendly.

DETAILED DESCRIPTION OF THE INVENTION

Figure 1:
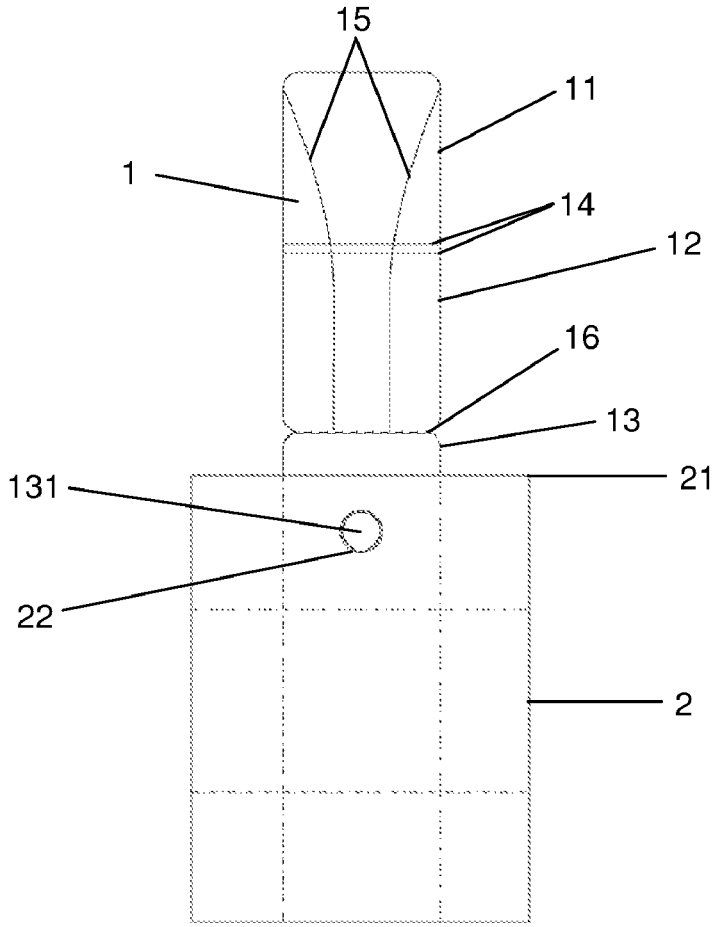
FIG. 1 shows an unfolded plane view of the present invention of the first embodiment.
Figure 2:
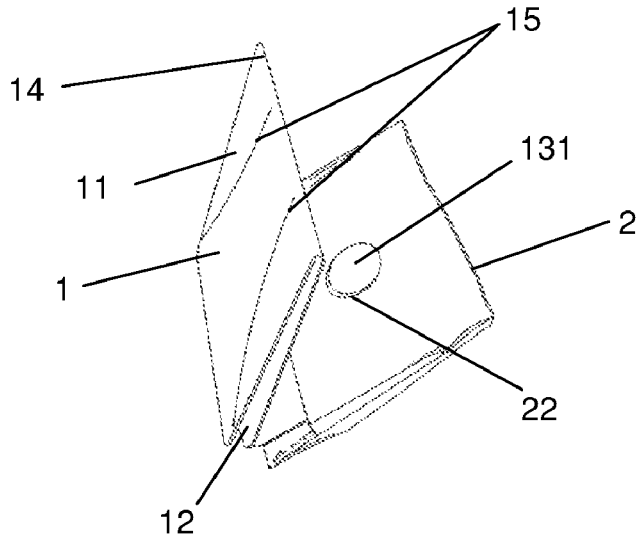
FIG. 2 shows a perspective view of the present invention of the first embodiment when it is being folded up for carrying.
Figure 3:
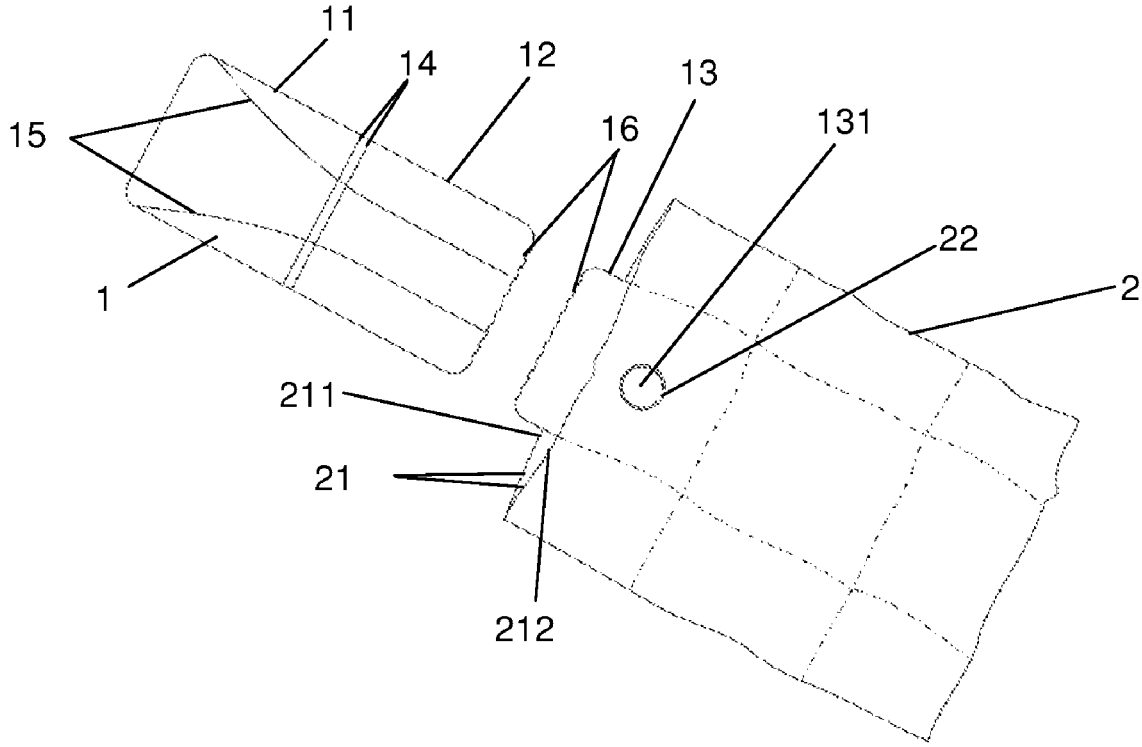
FIG. 3 shows a perspective view of the present invention of the first embodiment when the handle portion with the receptacle portion is torn off from the handle portion.

The present invention is further described in detail with the following embodiments and the accompanying drawings. FIGS. 1 to 5 illustrate the first embodiment of an animal litter collector of the present invention. As illustrated in FIGS. 1 to 3, the animal litter collector comprises a foldable board 1 and a foldable bag 2 having an opening 21, wherein the board 1 is thin, flat and elongated having a receptacle portion 11 at one end for receiving animal litter, a handle portion 12 in the middle for holding with the human hand, a fastening portion 13 at the other end with a fastener 131 for closing the opening of the foldable bag by fixing it in place. In this embodiment, the board 1 is made of cardboard or thick paper and the foldable bag 2 is made of paper as such materials are environmentally friendly. In other embodiments, the board 1 can be made of paper, plastic or wood other than cardboard and the foldable bag 2 can be made of plastic other than paper. In this embodiment, the foldable bag 2 is dark in color. The foldable bag 2 is preferably dark in color for making animal litter inside invisible from outside, but in other embodiments it can be light in color or even transparent. The opening 21 has two sides, namely, the first side 211 and the second side 212. The first side 211 is fixed onto the fastening portion 13 of the board 1. In this embodiment, the fastening portion 13 of the board 1 is attached onto the inner surface of the first side 211 by way of adhesive or any other known means. In other embodiments, not shown herein, the fastening portion 13 of the board 1 can be attached onto the outer surface of the first side 211.

Figure 1A:
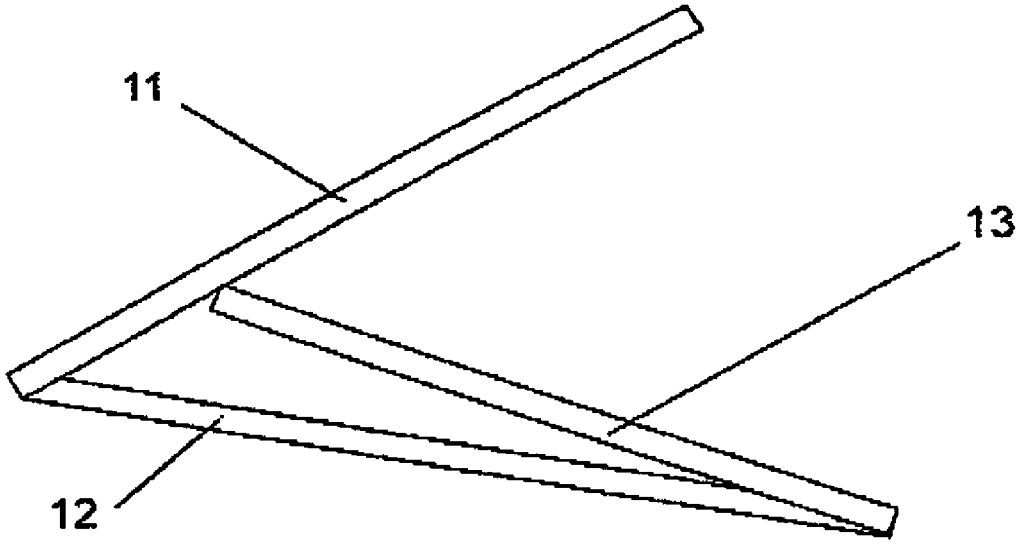
FIG. 1*a* illustrates the receptacle portion, the handle portion and the fastening portion being folded in a way that the fastening portion lies in between the other two portions.
Figure 1B:
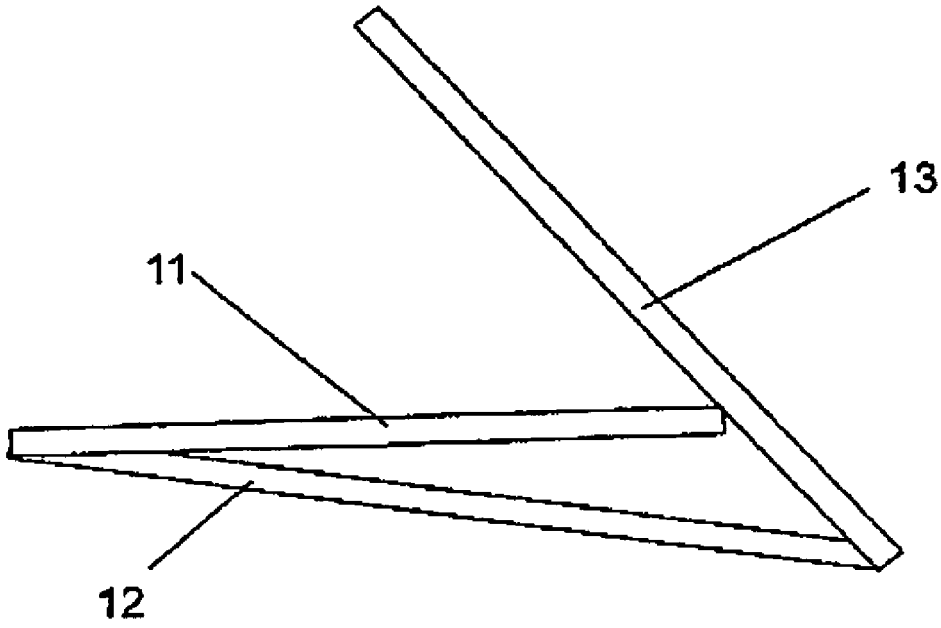
FIG. 1*b* illustrates the receptacle portion, the handle portion and the fastening portion being folded in a way that the receptacle portion lies in between the other two portions.
Figure 1C:
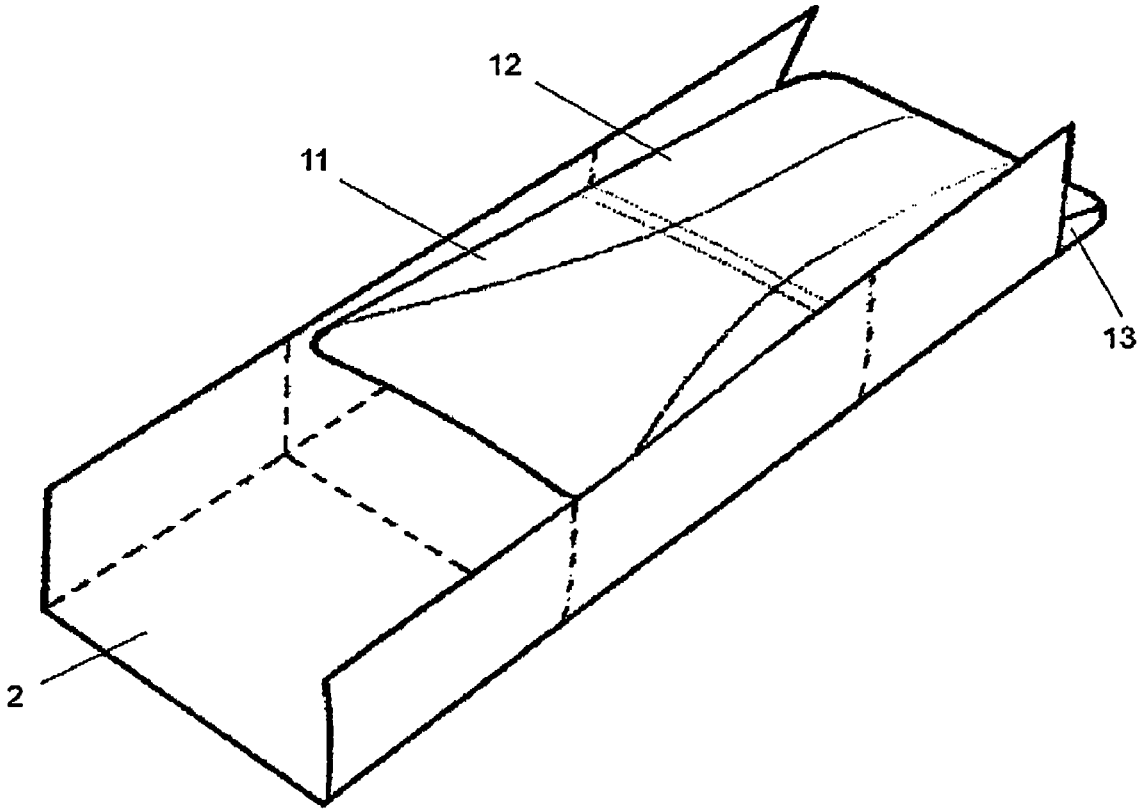
FIG. 1*c* shows a perspective view of the present invention of the first embodiment when it is being folded up in half.

As illustrated in FIG. 1, the receptacle portion 11 and the handle portion 12 have two pressed lines 14 in between which enable the receptacle portion 11 to be easily folded onto the handle portion 12. In other embodiments, not shown herein, the two pressed lines 14 can be substituted by perforated lines. Furthermore, the receptacle portion 11 and the handle portion 12 may not have any or may just have only one pressed line 14 or perforated line 14 and the folding can be done by hand. As illustrated in FIG. 2, in this embodiment, the three portions 11, 12, 13 can be folded in a way that the handle portion 12 lies in between the other two portions 11, 13. In other embodiments, not shown herein, the three portions 11, 12, 13 may not be folded or can be folded in a way that the fastening portion 13 lies in between the other two portions 11, 12 as shown in FIG. 1*a*, or the receptacle portion 11 lies in between the other two portions 12, 13 as shown in FIG. 1*b*, or as illustrated in FIG. 1*c*, the handle portion 12 together with the receptacle portion 11 can be folded onto the fastening portion 13 and the foldable bag 2 so that the animal litter collector is folded into half or approximately half of its size.

As illustrated in FIGS. 1 and 3, in this embodiment, the handle portion 12 and the fastening portion 13 have a tear-off line 16 in between which enables the handle portion 12 together with the receptacle portion 11 to be easily separated from the fastening portion 13.

Figure 4:
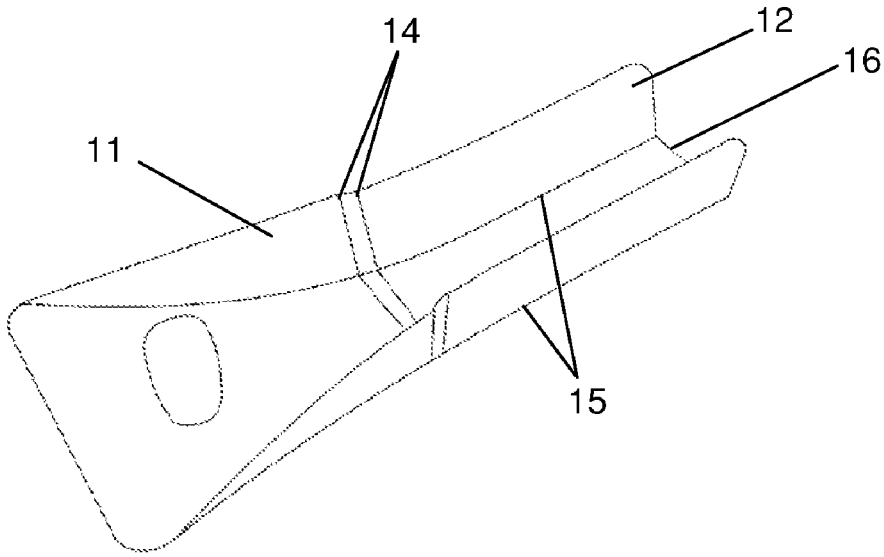
FIG. 4 shows a perspective view of the receptacle portion and the handle portion when they are in use.

As shown in FIGS. 1, 3 and 4, the receptacle portion 11 and the handle portion 12 have two curved pressed lines 15 which run from areas near the two corners of the receptacle portion 11 through the opposite side 14 of the receptacle portion 11 that connects to one side of the handle portion 12 and up to the opposite side 16 of the handle portion 12 enabling that the handle portion 12 and the receptacle portion 11 can be folded into a shovel-like implement for taking up animal litter. In other embodiments, not shown herein, the pressed lines can be substituted by perforated lines. Furthermore, the pressed lines 15 or the perforated lines 15 can run from the two corners or any other area near the two corners of the receptacle portion 11. The two curved pressed lines 15 are symmetrical in shape and position. It is preferably to have the two pressed lines 15 symmetrical in shape and position as it is easier to fold the handle portion 12 and the receptacle portion 11 into a shovel-like implement. In other embodiments, not shown herein, the two curved pressed lines 15 can be not symmetrical in shape and position. The two end points of the two curved pressed lines 15 on the handle portion 12 are in positions which separate the edge of the side 16 of the handle portion 12 into three sections of approximately equal length enabling that the handle portion 12 can be folded into a handle for ease of holding with the human hand. In other embodiments, not shown herein, the two end points can be in any positions on the edge of the side 16 of the handle portion 12.

As shown in FIGS. 1 to 3 and 5, the fastener 131 on the fastening portion 13 is in the form of a flap which is in the shape of a circle and opened on the fastening portion 13 with the bottom side attached to the fastening portion 13, and the foldable bag 2 has a hole 22 on the second side 212 of the opening 21 which side is not fixed onto the fastening portion 13, and the hole 22 is in size and position corresponding to the size and position of the flap 131 enabling that when the litter is disposed into the foldable bag 2, the second side 212 of the opening 22 is pulled down due to the weight inside and the flap 131 engages with the hole 22, thereby fixing the second side 212 of the opening 22 in place and keeping the opening of the foldable bag 2 closed. In other embodiments, not shown herein, the flap 131 on the fastening portion 13 can be in the shape of a semi-circle or any other shape which is opened on the fastening portion 13 with one side attached to the fastening portion 13.

In this embodiment, as shown in FIGS. 1 and 2, the receptacle portion 11 and the handle portion 12 are of the same size, and the fastening portion 13 is of the same width as that of the receptacle portion 11 or the handle portion 12 and its length is relatively shorter than that of the receptacle portion 11 or the handle portion 12 facilitating ease of folding and providing room for storing the foldable bag 2 which is fixed onto the fastening portion 13. The receptacle portion 11, the handle portion 12 and the fastening portion 13 can be folded into substantially one-third with the fastening portion 13 a bit shorter. There are no specific limitations on the size of the receptacle portion 11, the handle portion 12 and the fastening portion 13 so long as the board 1 can be folded into a compact size for ease of carrying.

The width of the opening 21 of the foldable bag 2 is greater than that of the receptacle portion 11 and that of the handle portion 12. The length of the foldable bag 2 is greater than the total length of the receptacle portion 11 plus the handle portion 12. There are no specific limitations on the size of the foldable bag 2 so long as it is large enough to hold the handle portion 12 and the receptacle portion 11 with animal litter thereon.

To use the present invention, as illustrated in FIGS. 1 to 3, the user can first unfold the receptacle portion 11, the handle portion 12, the fastening portion 13 and the foldable bag 2, and then tear off the handle portion 12 and the receptacle portion 11 from the fastening portion 13 along the tear-off line 16. As illustrated in FIG. 4, the user may then fold the receptacle portion 11 and the handle portion 12 along the two curved pressed lines 15, thereby making it into the shape of a shovel for picking up animal litter. The user then holds the handle portion 12 with one hand and uses the receptacle portion 11 to pick up the litter.

Figure 5:
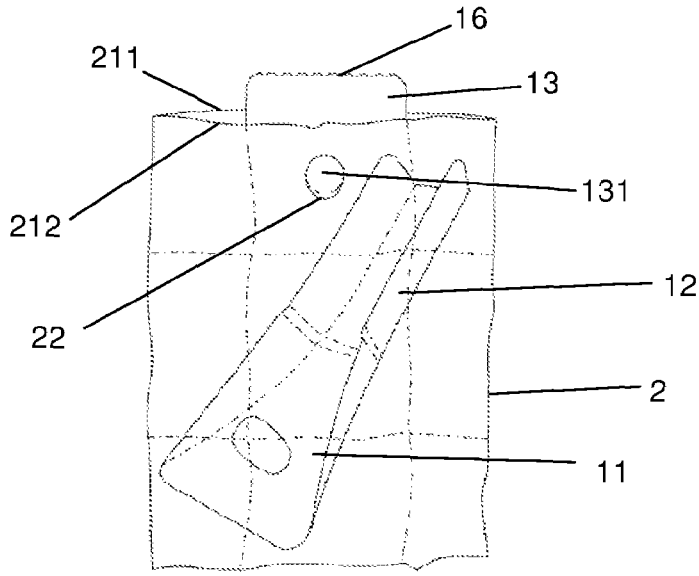
FIG. 5 shows a transparent perspective view of the present invention of the first embodiment when the receptacle portion and the handle portion together with the animal litter are put into the foldable bag.

After taking up the animal litter, as illustrated in FIG. 5, the user can put the handle portion 12 and the receptacle portion 11 with the litter hereon into the foldable bag 2. The user then uses the fastener 131 on the fastening portion 13 to keep the opening 21 of the foldable bag 2 closed.

FIGS. 6 to 10 illustrate the second embodiment of the present invention. The construction of this embodiment is similar to that of the first embodiment, save that the three portions 11, 12, 13 are arranged in a way that the handle portion 12 is at one end and the receptacle portion 11 is in the middle and the board 1 is folded in a way that the receptacle portion 11 lies in between the other two portions 12, 13.

Figure 6:
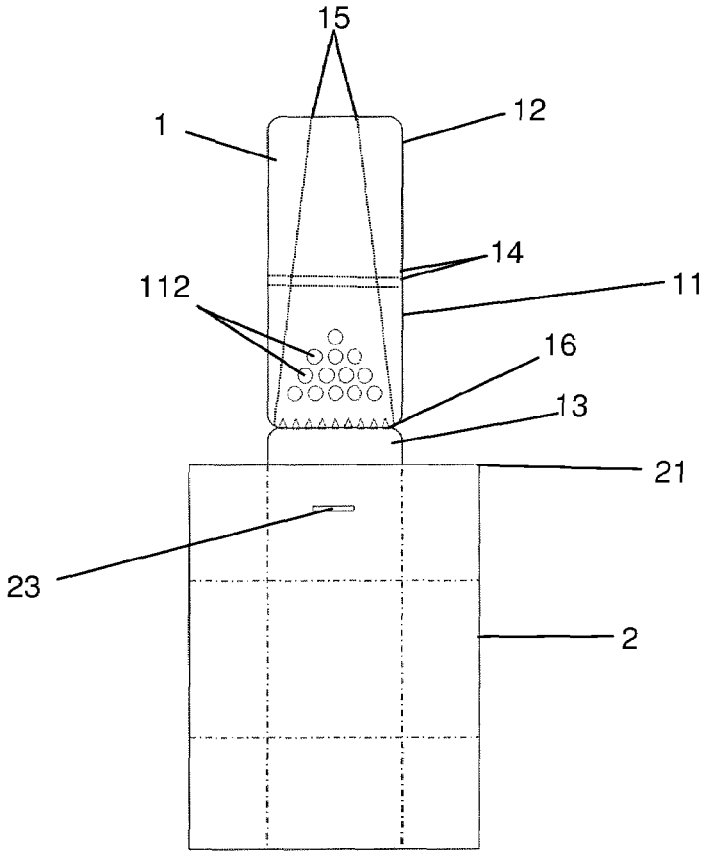
FIG. 6 shows an unfolded plane view of the present invention of the second embodiment.
Figure 7:
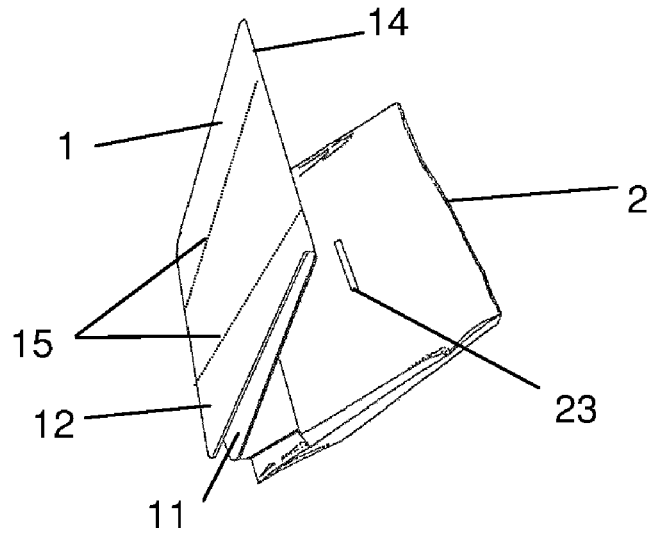
FIG. 7 shows a perspective view of the present invention of the second embodiment when it is being folded up for carrying.
Figure 8:
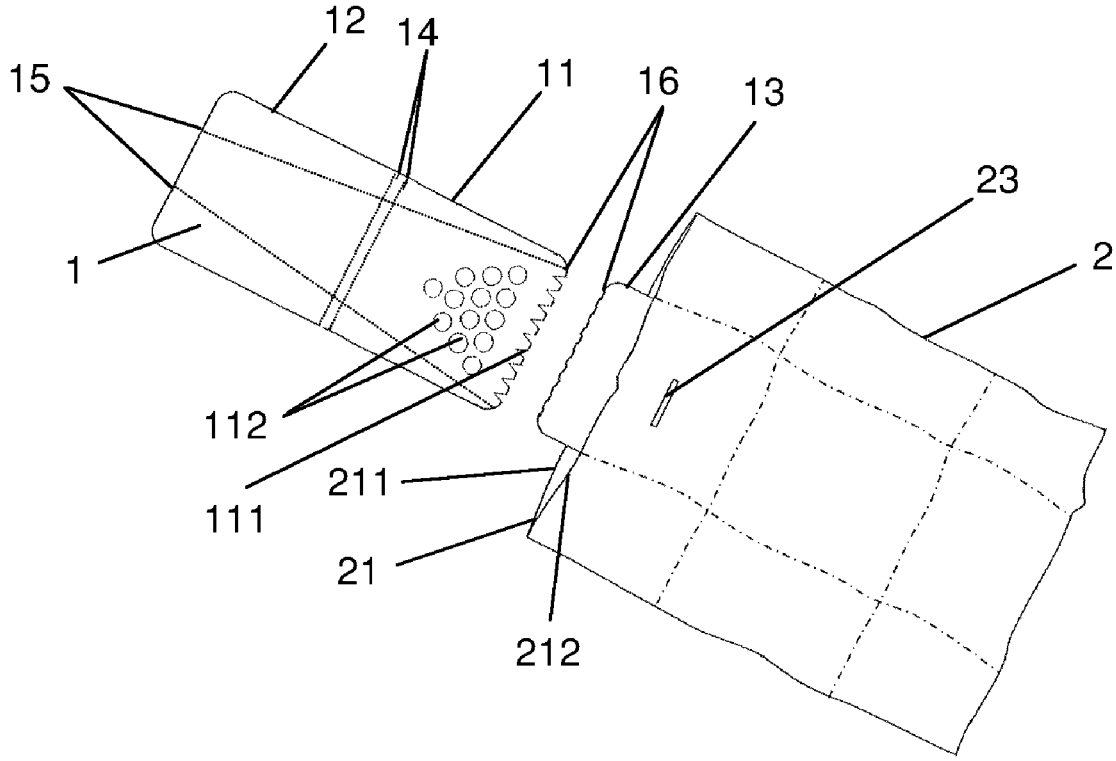
FIG. 8 shows a perspective view of the present invention of the second embodiment when the handle portion with the receptacle portion is torn off from the handle portion.
Figure 7A:
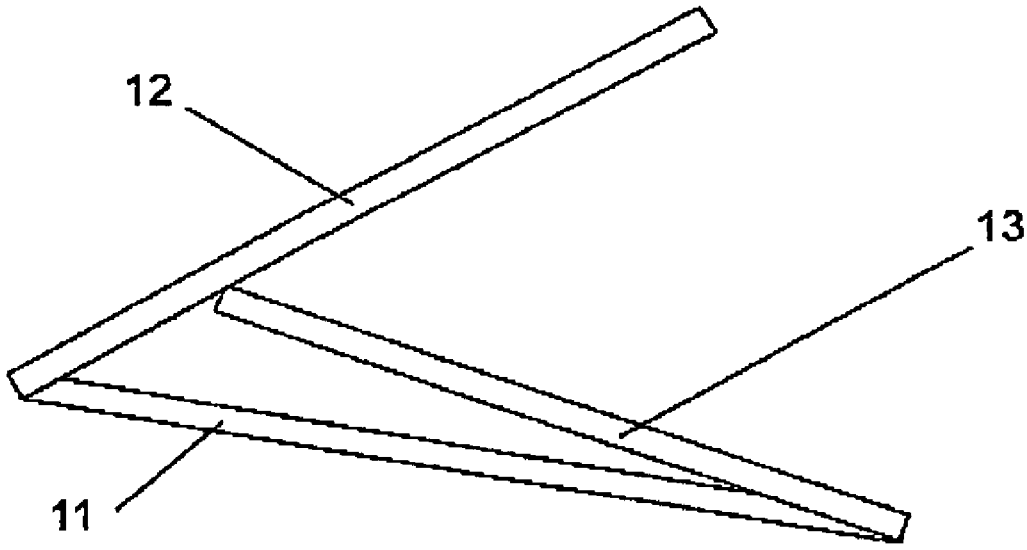
FIG. 7*a* illustrates the handle portion, the receptacle portion and the fastening portion being folded in a way that the fastening portion lies in between the other two portions.
Figure 7B:
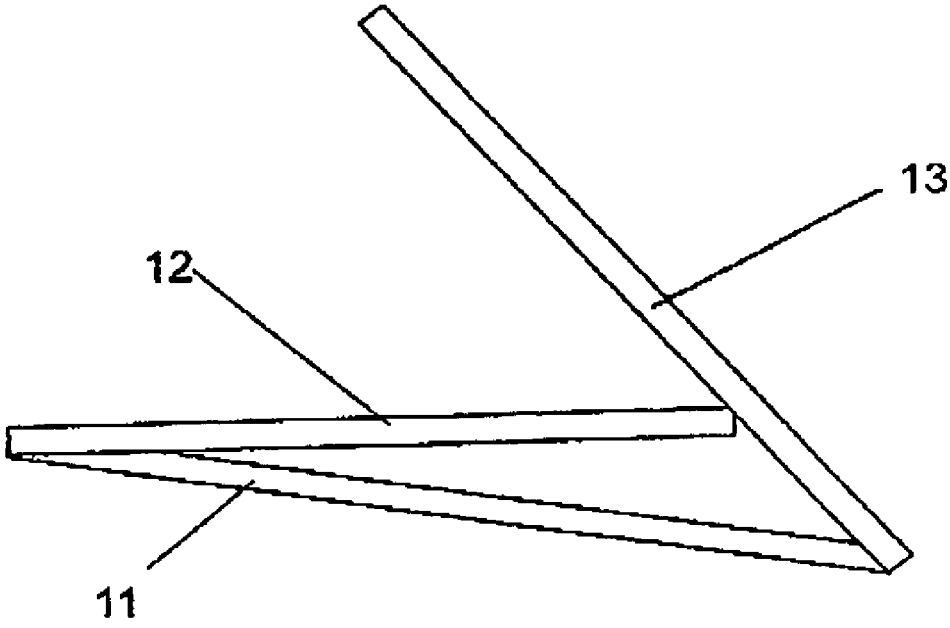
FIG. 7*b* illustrates the handle portion, the receptacle portion and the fastening portion being folded in a way that the handle portion lies in between the other two portions.
Figure 9:
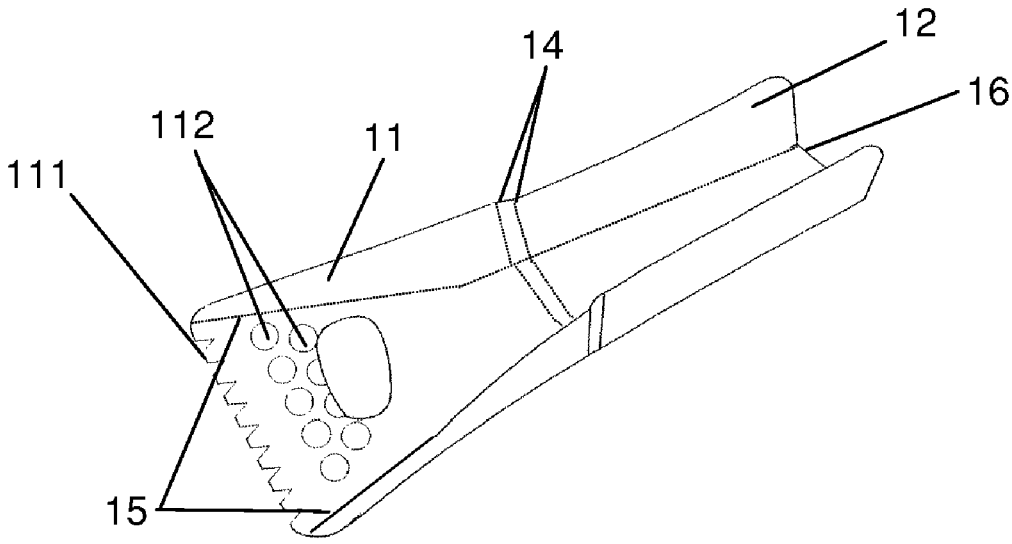
FIG. 9 shows a perspective view of the receptacle portion and the handle portion when they are in use.

Alternatively, as shown in FIG. 7*a*, the handle portion 12, the receptacle portion 11 and the fastening portion 13 may be folded in a way that the fastening portion 13 lies in between the other two portions 11, 12; or as shown in FIG. 7*b*, the handle portion 12, the receptacle portion 13 and the fastening portion 11 may be folded in a way that the handle portion 12 lies in between the other two portions 11, 13. Further, as shown in FIGS. 6 and 8, the tear-off line 16 lies between the receptacle portion 11 and the fastening portion 13 which enables the receptacle portion 11 together with the handle portion 12 to be easily separated from the fastening portion 13. As shown in FIGS. 6, 7 and 8, the receptacle portion 11, the handle portion 12 and the fastening portion 13 are of the same size so that the board 1 can be folded into one-third. In this embodiment, the two perforated lines 15 are inclined instead of curved, and the two inclined perforated lines 15 run from the two corners of the receptacle portion 11. The fastener 131 of this embodiment is in the form of a hanger which is opened on the fastening portion 13 with the bottom side attached to the fastening portion 13, and the foldable bag 2 has a cut line 23 on the second side 212 of the opening 21 which side is not fixed onto the fastening portion 13 and the cut line 23 is in size and position corresponding to the size and position of the hanger 131 enabling that the hanger 131 can engage with the cut line 23 to keep the opening 21 of the foldable bag 2 closed. Further, the front edge 111 of the receptacle portion 11 is toothed and in other embodiments it can be slanted instead for ease of taking up animal litter. The receptacle portion 11 also has a plurality of perforations 112 for filtering out excess grass, sand or stones when taking up animal litter.

To use the present invention, as illustrated in FIGS. 6 to 9, the user can tear off the receptacle portion 11 with the handle portion 12 from the fastening portion 13 along the tear-off line 16 and then fold the receptacle portion 11 and the handle portion 12 into the shape of a shovel along the inclined perforated lines 15 in the same way as in the first embodiment.

Figure 10:
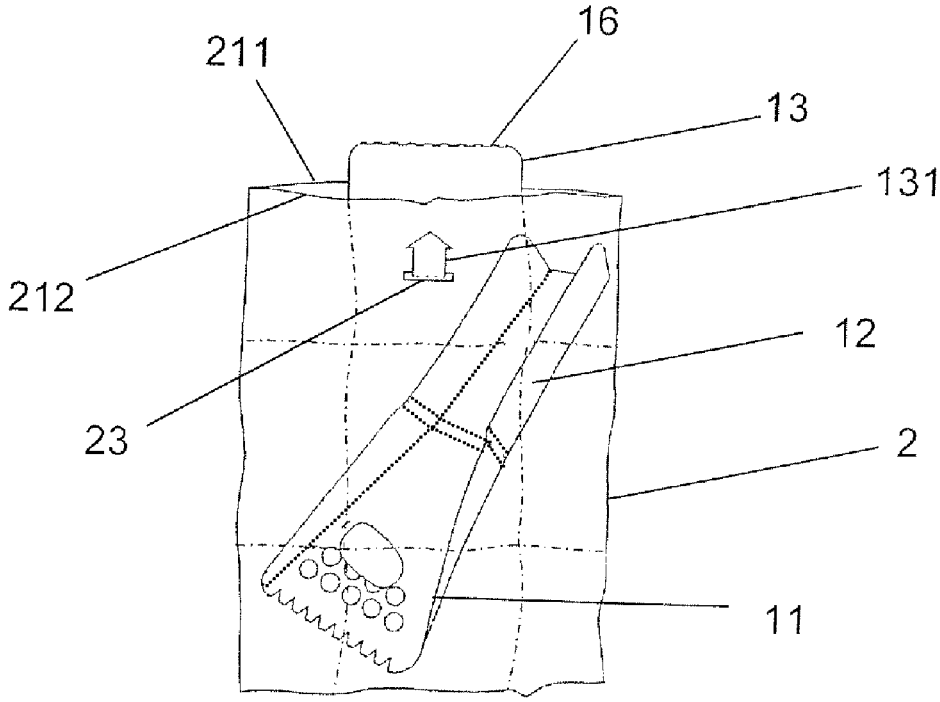
FIG. 10 shows a transparent perspective view of the present invention of the second embodiment when the receptacle portion and the handle portion together with the animal litter are put into the foldable bag.

After cleaning up the animal litter, the user can dispose the disposable animal litter collector in a way similar to that of the first embodiment, saved that as illustrated in FIG. 10, the user can engage the hanger 131 with the cut line 23 to fix the second side 212 of the opening 21 in place and to keep the opening 21 of the foldable bag 2 closed.

The above embodiments are preferred embodiments of the present invention. The present invention is capable of other embodiments and is not limited by the above embodiments. Any other variation, decoration, substitution, combination or simplification, whether in substance or in principle, not deviated from the spirit of the present invention, is replacement or substitution of equivalent effect and falls within the scope of protection of the present invention.

What is claimed is:

1. An animal litter collector, comprising a foldable board and a foldable bag having an opening, wherein the foldable board is thin, flat and elongated having a receptacle portion at one end for receiving animal litter, a handle portion in the middle for holding with the human hand and a fastening portion at the other end with a fastener for closing the opening of the foldable bag by fixing it in place, and the receptacle portion and the fastening portion are folded towards the handle portion respectively, so that after folding the receptacle portion or the fastening portion lies in between the other two portions; or alternatively the handle portion at one end and the receptacle portion in the middle; and the handle portion and the fastening portion are folded towards the receptacle portion respectively, so that after folding the handle portion or the fastening portion lies in between the other two portions; the handle portion together with the receptacle portion can be separated from the fastening portion; one side of the opening of the foldable bag is fixed onto the fastening portion of the board, and the fastener of the fastening portion is in shape and position that can engage with the other side of the opening to fix it in place and keep the opening closed after animal litter is disposed inside the foldable bag.

2. The animal litter collector as in claim 1, wherein the receptacle portion and the handle portion have at least one pressed line or perforated line in between enabling that one portion to be easily folded onto the other portion.

3. The animal litter collector as in claim 1, wherein the receptacle portion and the handle portion have two curved or inclined pressed lines or perforated lines which run from the two corners or areas near the two corners of one side of the receptacle portion through the opposite side of the receptacle portion that connects to one side of the handle portion and up to the opposite side of the handle portion enabling that the handle portion and the receptacle portion can be folded into a shovel-like implement for taking up animal litter.

4. The animal litter collector as in claim 3, wherein the two curved or inclined pressed lines or perforated lines are symmetrical in shape and position.

5. The animal litter collector as in claim 3, wherein the two end points of the two curved or inclined pressed lines or perforated lines on the handle portion are in positions which separate the edge of the side of the handle portion into three sections of approximately equal length enabling that the handle portion can be folded into a handle for ease of holding with the human hand.

6. The animal litter collector as in claim 1, wherein the handle portion and the fastening portion have a tear-off line in between which enables the handle portion together with the receptacle portion to be easily separated from the fastening portion.

7. The animal litter collector as in claim 1, wherein the receptacle portion and the fastening portion have a tear-off line in between which enables the receptacle portion together with the handle portion to be easily separated from the fastening portion.

8. The animal litter collector as in claim 1, wherein the fastener on the fastening portion is in the form of a hanger which is opened on the fastening portion with the bottom side attached to the fastening portion, and the foldable bag has a hole or a cut line on the other side of the opening which side is not fixed onto the fastening portion, and the hole or the cut line is in size and position corresponding to the size and position of the hanger enabling that when the litter is disposed into the foldable bag, the other side of the opening is pulled down due to the weight inside and the hanger engages with the hole or the cut line, thereby fixing the other side of the opening in place and keeping the opening of the foldable bag closed.

9. The animal litter collector as in claim 1, wherein the fastener on the fastening portion is in the form of a flap which is opened on the fastening portion with one side attached to the fastening portion, and the foldable bag has a cut line or a hole on the other side of the opening which side is not fixed onto the fastening portion and the cut line or the hole is in size and position corresponding to the size and position of the flap enabling that the flap can engage with the cut line or the hole to fix the other side of the opening in place and to keep the opening of the foldable bag closed.

10. The animal lifter collector as in claim 1, wherein the receptacle portion, the handle portion and the fastening portion are of the same size or substantially the same size.

11. The animal litter collector as in claim 10, wherein the receptacle portion, the handle portion and the fastening portion can be folded into one-third or substantially one-third.

12. The animal litter collector as in claim 1, wherein the receptacle portion and the handle portion are of the same size or substantially the same size, and the fastening portion is of the same width as that of the receptacle portion or the handle portion and its length is relatively shorter than that of the receptacle portion or the handle portion facilitating ease of folding and providing room for storing the foldable bag which is fixed onto the fastening portion.

13. The animal litter collector as in claim 1, wherein the width of the opening of the foldable bag is greater than that of the receptacle portion and that of the handle portion.

14. The animal litter collector as in claim 1, wherein the length of the foldable bag is greater than the total length of the receptacle portion plus the handle portion.

15. The animal litter collector as in claim 1, wherein the board is made of paper, cardboard, plastic or wood.

16. The animal litter collector as in claim 1, wherein the foldable bag is made of paper or plastic.

17. The animal litter collector as in claim 1, wherein the foldable bag is dark in color for making animal lifter inside invisible from outside.

18. The animal litter collector as in claim 1, wherein the edge of the side of the receptacle portion that is used to pick up animal lifter is slanted or toothed for facilitating ease of taking up.

19. The animal litter collector as in claim 1, wherein the receptacle portion has a plurality of perforations for filtering out excess grass, sand or stones when taking up animal litter.

* * * * *